United States Patent [19]

Novy

[11] 3,973,464

[45] Aug. 10, 1976

[54] PISTON VALVED BRASS-WIND MUSICAL INSTRUMENT

[76] Inventor: Donald A. Novy, 1000 S. Monaco Parkway, Denver, Colo. 80220

[22] Filed: Oct. 30, 1975

[21] Appl. No.: 627,201

[52] U.S. Cl. ..... 84/392
[51] Int. Cl.[2] ..... G10D 9/04
[58] Field of Search ..... 84/388–394

[56] References Cited

UNITED STATES PATENTS

| | | | |
|---|---|---|---|
| 1,367,386 | 2/1921 | Hawkins | 84/392 |
| 1,821,397 | 9/1931 | Olds | 84/392 |
| 2,798,401 | 7/1957 | Miller | 84/392 |

*Primary Examiner*—Lawrence R. Franklin
*Attorney, Agent, or Firm*—Bertha L. MacGregor

[57] ABSTRACT

A piston valved brass-wind musical instrument having a plurality of elliptically constricted apertures and of displacements of bore, for example six such apertures and five displacements of bore, in the valves section of its air column. Each of the valves, usually three in number, is offset a precise amount so that a discontinuity is created between the valve bore and the valve casing port. The exact ratio of the offset distance is, from the third valve to the first valve of a three valved instrument, 4:2:1, or 1:2:4.

11 Claims, 8 Drawing Figures

PISTON VALVED BRASS-WIND MUSICAL INSTRUMENT

BACKGROUND OF THE INVENTION

1. Field of the Invention

This invention relates to musical brass-wind instruments of the type employing piston valves, which includes trumpets, cornets, fluegelhorns, valve trombones, bass trumpets, baritone horns, alto horns, valved bugles, tubas, and sousaphones.

2. Description of the Prior Art

Designers of piston valved instruments have sought to attain the optimum shape of the air column therein contained in order to produce resonant frequencies most nearly matching the musically desirable frequencies of the tempered scale. The direction of research has been to reshaping the bell and leader pipe portions of the air column.

It is known in the art that an abrupt change of circular cross section of a tube introduces increased impedance and that the effect of such a discontinuity is to introduce an inductance in series with the standing waves of the air column, thereby producing a reinforced response in the instrument. It is also known that the playable intonation, here defined as the capability of an instrument to be easily adjusted in pitch by use of lip control and exitatory air flow changes at the player's embouchure and mouth cavity, is improved with increased oscillation of the air column.

Prior art teaches that the valves portion of the air column should present little or no discontinuity of bore. Slight constrictions and misalignments in the valve pistons have been cited as the cause of shortcomings in the performance of some instruments. In all known commercial trumpets the valve bore diameter is constant through the valves area and all valve pistons are aligned, with all piston and valve casing ports matching.

SUMMARY OF THE INVENTION

An object of the invention is to modify the valves portion of the air column in order to obtain increased oscillation and thereby to attain improved intonation, reinforced response, and greater range of the instrument. Another important object is to use a precise system of discontinuities of bore at a fixed point in the instrument's air column to create improved response, here defined as more immediate propagation of sound, and effective upward extension of the instrument's playable frequency range, resulting from increased peaks of input impedance at higher frequencies of vibration of the air column.

Description of the Preferred Embodiment

Figure 1:
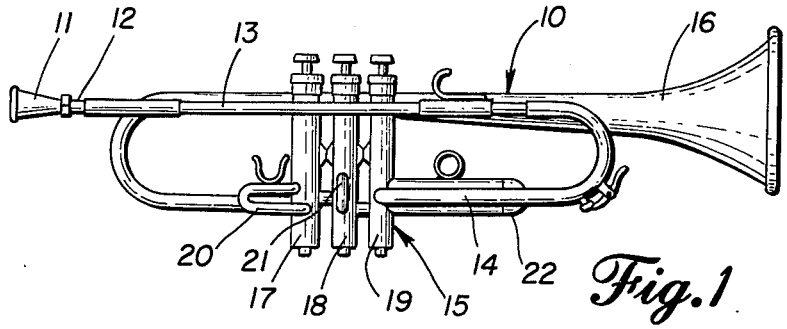
FIG. 1 is an elevational view of a trumpet.
Figure 2:
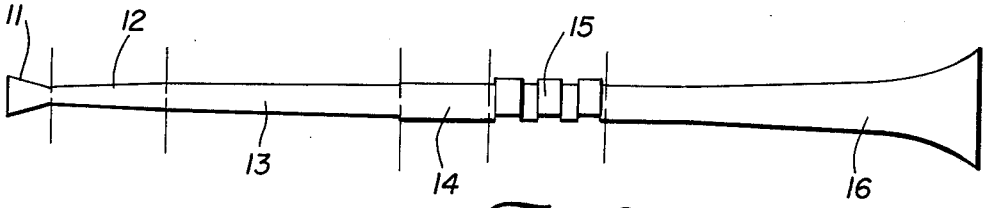
FIG. 2 is a diagrammatic illustration of a typical valved brass-wind instrument showing the portions essential for description of the invention.

The invention applies to all piston valved brass-wind musical instruments. In FIGS. 1 and 2, the typical construction of a trumpet 10 embodying the invention is shown to comprise a mouthpiece 11, backbore 12, leader pipe 13, main tube 14 containing the valves portion 15, and bell 16, all of which define the air column of the instrument. The valves are designated as first 17, second 18 and third 19, in respective order in the air column from bell to mouthpiece. 20 designates the first valve conduit, 21 the second valve conduit and 22 the third valve conduit.

Figure 3:
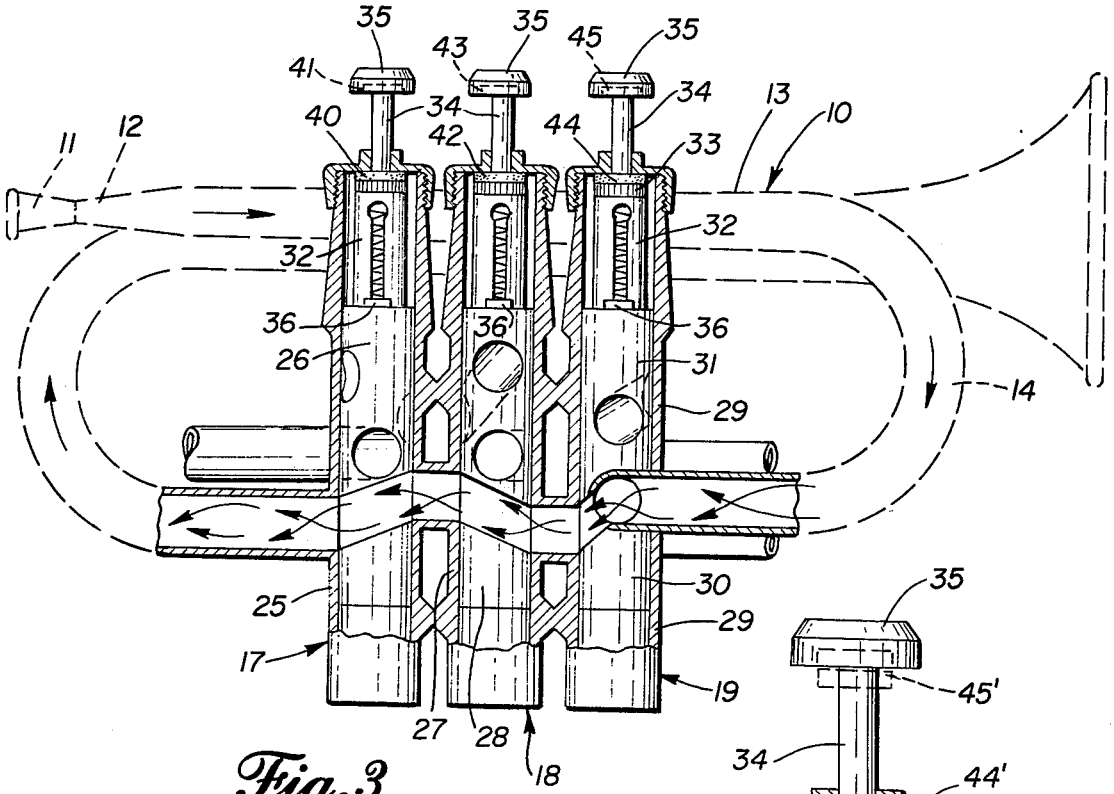
FIG. 3 is a vertical sectional view of the valves section of a brass-wind instrument showing acoustical waves of a standard instrument.

In FIG. 3, the first valve casing 25 has a first valve piston 26 slidable therein; the second valve casing 27 has a second valve piston 28; the third valve casing 29 has a third valve piston 30 therein.

Each of the valves 17, 18, 19 has a valve port section 31, a spring enclosure 32, a valve stem seat 33, valve stem 34, valve cap 35 and spring seat guide 36.

The ports in the valve port sections 31 are aligned with the main tube 14, and each piston 26, 28, 30 has a bore providing a path defining the air column between the casing ports.

Figure 4:
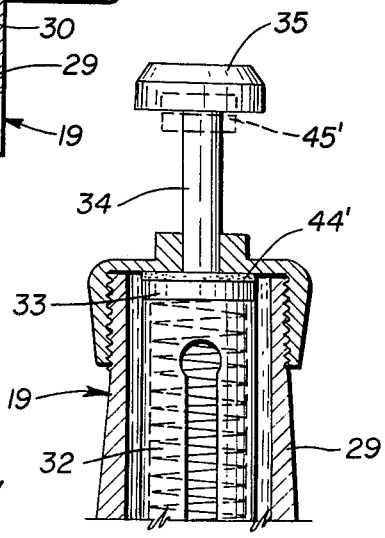
FIG. 4 is an enlarged vertical sectional view of a portion of a valve showing the location of a valve cap pad and a piston pad in an instrument embodying the invention.

As shown in FIG. 3, the first valve 17 is provided with a piston pad 40 and a valve cap pad 41; the second valve 18 is provided with a piston pad 42 and a valve cap pad 43; and the third valve 19 is provided with a piston pad 44 and a valve cap pad 45. FIG. 4 illustrates how the pads are modified for functioning of the invention, as indicated by piston pad 44' and piston cap pad 45'. Pad 44 is reduced in thickness by a predetermined amount to form pad 44' and the thickness of pad 45 is increased by the same predetermined amount to form pad 45'. This alteration of the pads will cause the piston bore to be raised relatively to the casing ports, but if desired the same offset may be established by lowering the piston ports from perfect alignment by thickening pad 44 and reducing pad 45 by the said predetermined amount. The same process is used on pads 40–43 to either raise or lower the piston bore in the first and second valves. This coordinated alteration of the pads on each piston preserves the original length of stroke when the valve is operated. The invention is functional when the valves are operated also, preserving the offsets when the air column is routed through conduits 20, 21 or 22.

Figure 7:
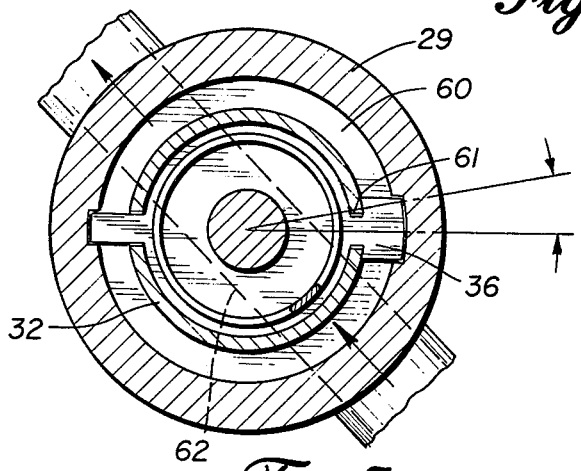
FIG. 7 is a horizontal sectional view taken in a plane between the spring enclosure and the valve of FIG. 6.
Figure 8:
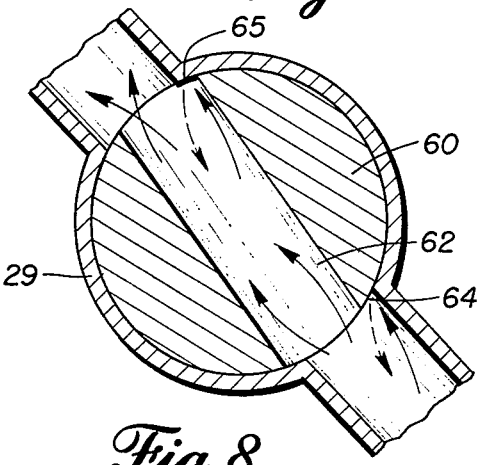
FIG. 8 is a diagrammatic view through the valve of FIG. 6, showing the offsets in the valve bore and acoustical waves produced by the invention.
Figure 6:
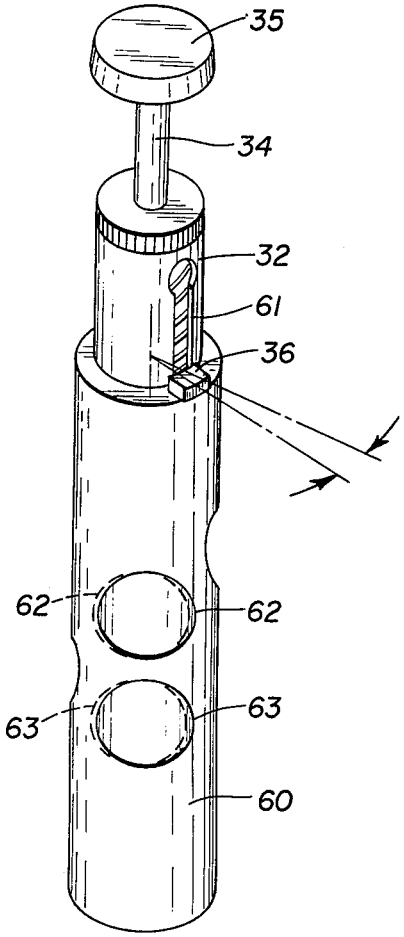
FIG. 6 is an elevational view, enlarged, of one of the valves which has been rotated about its vertical axis to produce elliptical constriction of the valve ports laterally of the ports.

The spring seat guide 36 FIGS. 6–8, holds the piston in alignment against rotation in the casing by engagement with a notch in the casing.

Figure 5:
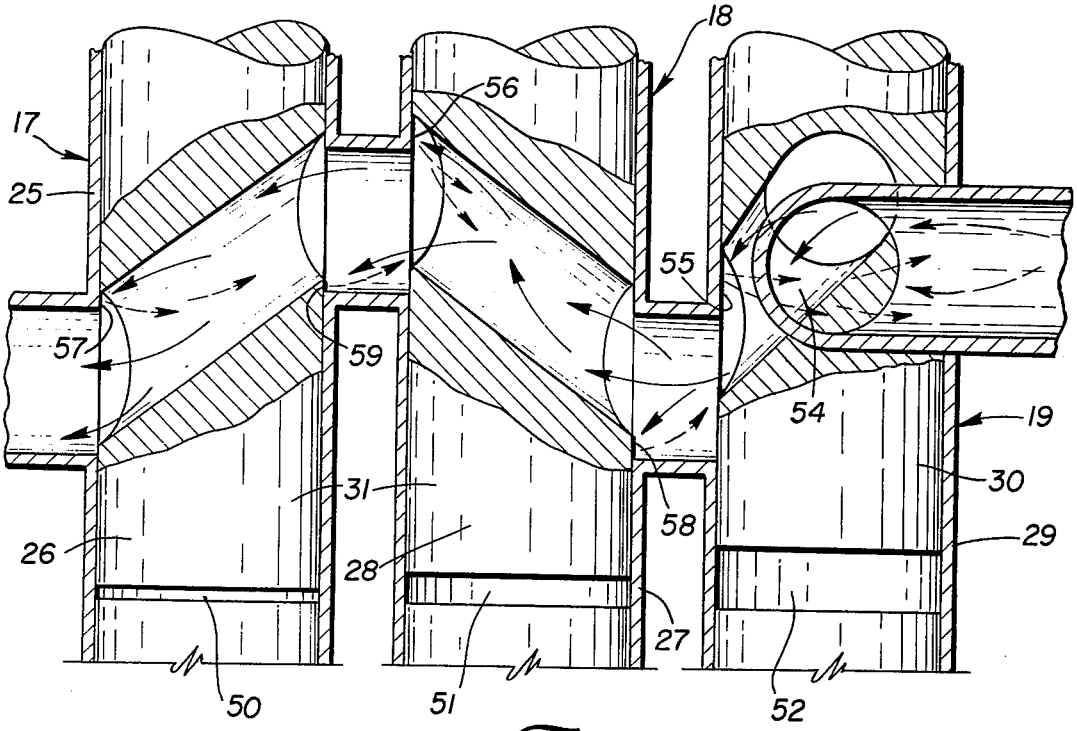
FIG. 5 is an enlarged vertical sectional view of part of the valves section showing acoustical waves produced in an instrument embodying the invention by alteration of the valve cap pads and piston pads, showing the amount of offset to an exaggerated degree for clarity.

Each valve bore is offset from perfect alignment with the casing port and main tube 14 by a precise amount. In FIG. 5, the third valve 19 has the greatest offset, the second valve 18 is offset one-half the distance used for the third valve, and the first valve 17 is offset one-half the distance used in the second valve. Thus the offset distance ratio from the third to the first valve is 4:2:1. The preferred amount of offset can be expressed as a percentage of the valve bore diameter and is thereby applicable to all valve bore sizes, but for clarity the offset of a trumpet using standard ML bore size of 0.460 in. diameter is also given: The third valve piston is offset 0.892 mm (0.0351 in.) or 7.63% of its valve bore diameter; the second has one-half this offset; and the first has one-half the offset of the second.

The amount of offset is subject to some variation without losing the benefits of the invention. This variation may be approximately one eighth the greatest offset or approximately 0.95% of the valve bore diameter. In the case of the valve having the greatest offset, usually the third valve, the stated 7.63% may be the maximum offset with premissible variation in offset resulting in as little as 6.68% offset. Each valve must be offset to some degree, however, for the proper operation of the invention.

The effect of the pad thickness adjustment is illustrated in FIG. 5, where 50 represents the relative offset seen at the bottom of the first valve piston, 51 the relative offset at the bottom of the second valve piston and 52 the relative offset at the bottom of the third valve piston. The offset surfaces designated 55, 56 and 57 at the upper edge of the bore and offsets designated 54, 58 and 59 at the lower edge of the bore (FIG. 5) deflect sound waves as shown by solid arrows and deflect deflected sound waves as shown by dashed arrows.

A resulting system of six elliptically constricted apertures and five displacements of bore is created in the general form of an initially constricted offset sectioned flare within the valved portion of the air column. The result is achieved by a number of mechanical means, such as illustrated herein. As shown in FIGS. 4 and 5, the thickness of the piston pads 40, 42 and 44 and valve cap pads 41, 43 and 45 have been adjusted to relocate each piston the desired distance. In other words, the pistons are thus relocated to produce the described discontinuities, thereby relocating all piston ports the desired distances. A second means is to lengthen or shorten the spring enclosure from the conventional arrangement either at the junction with the valve port section of the piston or at the junction with the valve stem seat. Another means for achieving the described discontinuities is illustrated in FIGS. 6–8, by rotating the valve port section relative to the spring seat guide through an appropriate angle as shown in FIGS. 6 and 7. In FIG. 6, the valve is designated 60, with a slot 61 in the spring enclosure 32, and ports 62, 63, producing offsets 64, 65 by the described rotation of the valve. In whichever method is used, all three valves should be altered in the same manner: all piston bores offset upward, all offset downward, or all offset by rotation in the same direction. This uniformity produces consistent characteristics in the offset sectioned flare. The invention will also function when the ratio of offsets is reversed: from third to first valves it may be 1:2:4, but the prior mentioned ratio is preferred.

I claim:

1. A piston valved brass-wind musical instrument of the type having tubing defining an air column, a valve comprising a valve casing traversing said tubing and portedly connected thereto, a valve piston slidable within said casing and having a circular bore connecting the casing ports, wherein the improvement comprises said piston and said casing having a precise offset from perfect alignment between the casing ports and piston bore.

2. The instrument defined by claim 1 having a plurality of valves wherein the offsets comprise an initially constricted, offset, sectioned flare within the air column.

3. The instrument defined by claim 2 wherein the valves are three in number and the relative offset distances of the valves from the third to the first are in the ratio of 4:2:1.

4. The instrument defined by claim 3, wherein the precise offset of the third valve is 7.63% of the diameter of the piston bore.

5. The instrument defined by claim 3, wherein the offset of the third valve is from 6.68% of the diameter of the piston bore.

6. The instrument defined by claim 2, wherein said instrument is a trumpet.

7. The instrument defined by claim 1, further comprising mechanical means for fixing the offset distance between the valve bore and casing port.

8. The instrument defined by claim 7, wherein said mechanical means is a spring seat guide attached to the valve piston and holding said piston in a degree of rotation offsetting said bore from perfect alignment with said casing port in a plane perpendicular to the axis of slidable motion of said piston within said casing.

9. The instrument defined by claim 7, wherein said mechanical means is a pad mounted on said piston, limiting the vertical movement of said piston at the ends of its slidable travel at a point where the valve bore is offset from perfect alignment with the casing bore by a precise distance.

10. The instrument defined by claim 7, wherein said mechanical means holds the piston in a degree of rotation offsetting said bore from perfect alignment with said casing port about the piston's longitudinal axis by a precise predetermined distance.

11. The instrument defined by claim 1 having three valves wherein the relative offset distances of the valves from the third to the first are in a ratio of 1:2:4.

* * * * *